US009297089B2

(12) United States Patent
Berger et al.

(10) Patent No.: US 9,297,089 B2
(45) Date of Patent: Mar. 29, 2016

(54) COATINGS FOR GAS TURBINE COMPONENTS

(75) Inventors: Charles Clifford Berger, New City, NY (US); David John Wortman, Hamilton, OH (US)

(73) Assignee: Barson Composites Corporation, Old Bethpage, NY (US)

( * ) Notice: Subject to any disclaimer, the term of this patent is extended or adjusted under 35 U.S.C. 154(b) by 881 days.

(21) Appl. No.: 13/543,423

(22) Filed: Jul. 6, 2012

(65) Prior Publication Data

US 2013/0011270 A1 Jan. 10, 2013

Related U.S. Application Data

(60) Provisional application No. 61/505,724, filed on Jul. 8, 2011.

(51) Int. Cl.

| | |
|---|---|
| ***C25D 3/50*** | (2006.01) |
| ***C25D 5/50*** | (2006.01) |
| ***C25D 7/10*** | (2006.01) |

(52) U.S. Cl.

CPC ... *C25D 5/50* (2013.01); *C25D 7/10* (2013.01)

(58) Field of Classification Search

CPC ..... C23C 8/00; C23C 8/02; C23C 8/04; F01D 5/28; F04D 29/26

See application file for complete search history.

(56) References Cited

U.S. PATENT DOCUMENTS

| | | | | |
|---|---|---|---|---|
| 2005/0079368 | A1 * | 4/2005 | Gorman et al. | 428/469 |
| 2008/0152814 | A1 * | 6/2008 | Rucker et al. | 427/383.1 |
| 2009/0162209 | A1 | 6/2009 | Wortman et al. | |

* cited by examiner

*Primary Examiner* — Edward Look
*Assistant Examiner* — Maxime Adjagbe
(74) *Attorney, Agent, or Firm* — Reising Ethington P.C.

(57) ABSTRACT

A gas turbine component for use in a gas turbine engine includes a substrate and a non-aluminide protective coating with a platinum-group metal. The platinum-group metal resides in a gamma-prime phase of the underlying material. The platinum-group metal can impart the protective coating with superior corrosion-resistance, while the absence of aluminide in the protective coating facilitates use of the protective coating at high-stress and/or high-fatigue portions of the component. The protective coating optionally includes chromide and can also be combined with aluminide at select portions of the component.

20 Claims, 2 Drawing Sheets

COATINGS FOR GAS TURBINE COMPONENTS

REFERENCE TO RELATED APPLICATIONS

This application claims the benefit of U.S. Provisional Ser. No. 61/505,724 filed on Jul. 8, 2011, the entire contents of which are incorporated herein by reference.

TECHNICAL FIELD

This disclosure generally relates to coatings and surface treatments for gas turbine components.

BACKGROUND

Certain gas turbine components operate in a harsh environment that may expose the component to high temperatures, high mechanical stresses, and potentially reactive combustion gases. The possible effects of this type of operating environment may be considered when selecting turbine component materials. For example, material characteristics such as resistance to heat, stress, fatigue, corrosion, erosion, and/or oxidation may be considered. Material costs and manufacturability may be considered as well, along with numerous other factors.

SUMMARY

In accordance with one embodiment, a gas turbine component for use in a gas turbine engine includes a substrate and a non-aluminide protective coating. The substrate includes a Ni-based superalloy base material, and the non-aluminide protective coating is disposed over at least a portion of the base material. The protective coating includes a platinum-group metal.

In accordance with another embodiment, a gas turbine blade includes a platform having an underside and an opposite topside and an airfoil portion that includes an airfoil and the topside of the platform. The gas turbine blade further has a shank portion that includes a shank and the underside of the platform. A platinum-group metal is interdiffused with at least a portion of both of the airfoil portion and the shank portion, and the shank portion is non-aluminized.

In accordance with another embodiment, a method of coating a gas turbine blade for use in a gas turbine engine includes the step of interdiffusing a platinum-group metal with a base material of at least a portion of a shank portion of a turbine blade substrate.

In accordance with another embodiment, a non-aluminide corrosion-resistant coating comprises a platinum-group metal and a gamma/gamma prime microstructure.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION

The protective coatings described herein may be used on gas turbine blades or other gas turbine components such as compressor blades, turbine or compressor vanes, seals, rotors or hubs, shafts, or any other component that may encounter the harsh environment present in a gas turbine or other type of combustion engine. Coatings arranged, produced, or used as taught herein may protect underlying component materials from corrosion and oxidation without substantially changing the ductility of the underlying materials, thereby improving the service life of the component by helping to improve its fatigue strength compared to components that include other less ductile coatings. These coatings may also be used in other non-turbine applications with components that may operate under high stress conditions, at elevated temperatures, and/or in a corrosive environment. As used herein, the term "corrosion" may be used to refer to oxidation, which is a specific form of corrosion, along with other types of corrosion.

Figure 1:
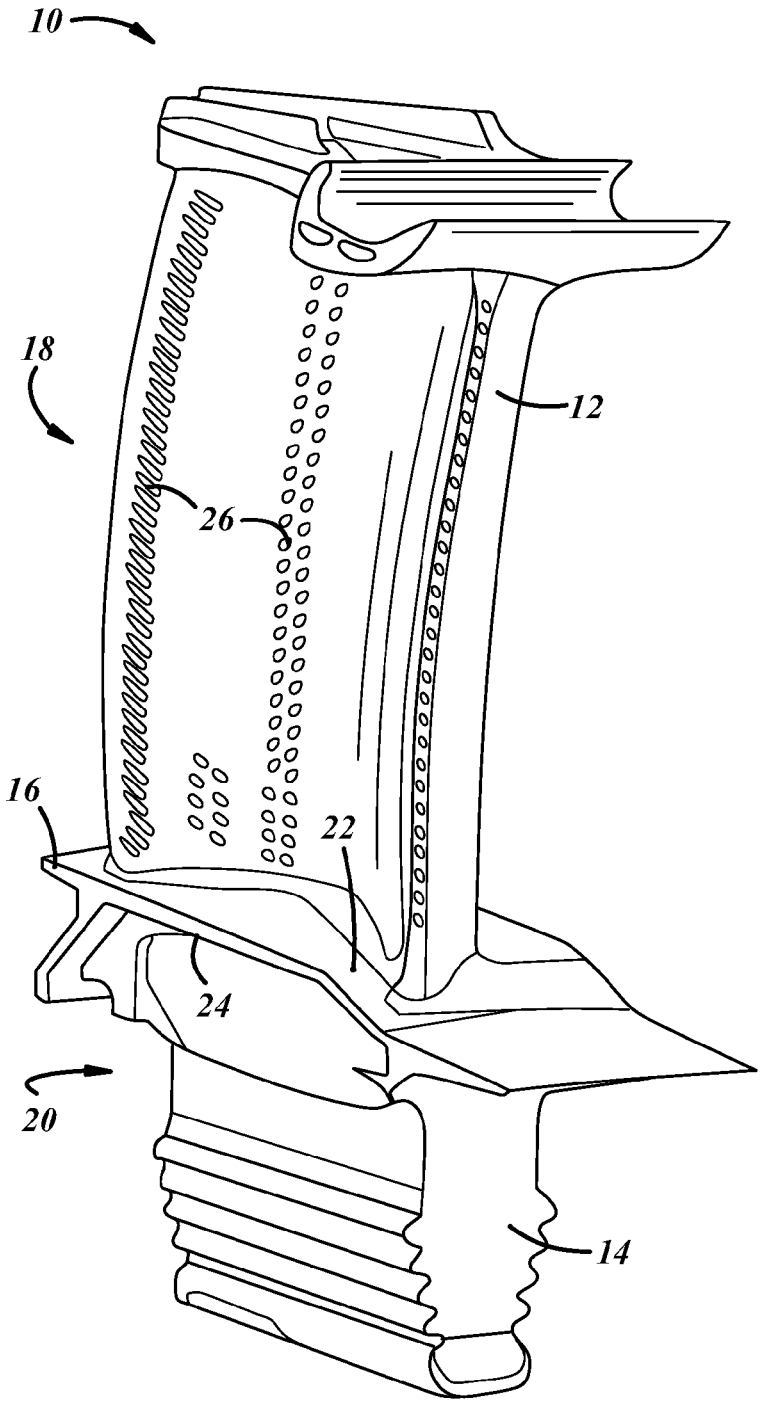
FIG. 1 is a perspective view of an exemplary gas turbine component that may include the protective coatings described herein.

Referring to FIG. 1, an exemplary gas turbine component is shown. In this embodiment, the component is a gas turbine blade 10. Turbine blade 10 includes an airfoil 12 and a shank 14, each extending from opposite sides of a platform 16. The airfoil 12 may include a cross-section or profile configured to cause high and low pressure regions on opposite sides thereof when placed in a particular orientation in a flowing fluid, thus causing the blade 10 to move in the direction of lower pressure. Shank 14 may be used as part of an attachment to secure the blade to a hub or other component that rotates about a central axis. Shank 14 may include several features not individually described here, such as a root, neck, ridges, sealing flanges, "angel wings," etc. In operation, multiple blades 10 may be arranged so that the airfoils extend radially away from the central axis of the hub to form a turbine that can transform energy from axial gas flow into rotational motion, or vice versa where the blade is used as part of a compressor.

Platform 16 lies between the airfoil 12 and the shank 14, generally dividing the blade into an upper boundary portion 18 and a lower boundary region 20. The upper boundary region 18, also referred to as the gas path region, is exposed to combustion gases during operation and includes the airfoil 12 and a topside 22 of the platform 16. The lower boundary region 20 is generally not exposed to combustion gases during operation and includes an underside 24 of the platform 16 and any other blade components under the platform 16 or on the shank side of the platform 16. Blade 10 may include some relatively high stress regions near platform 16 when in operation. For example, a high stress region may be located where shank 14 meets the underside 24 of the platform 16 or where airfoil 12 meets the topside 22 of the platform 16, due to the transitions in the shape of the blade in those regions. This arrangement of components in turbine blade 10 may also result in the lower boundary region 20 operating at temperatures lower than those at which the gas path region 18 operates. For example, the lower boundary region 20 may operate at temperatures that range from about 1200-1600° F., while the gas path region 18 may operate at higher temperatures that may range from about 1900-2100° F. For purposes of this disclosure, the gas path region 18 may also be referred to as the airfoil portion, and the lower boundary region 20 may be referred to as the shank portion.

In the illustrated embodiment, turbine blade 10 also includes internal cooling channels 26, the ends of some of which are shown along the airfoil surface. Channels 26 may extend from one or more surfaces of the shank portion 20 to one or more surfaces of the airfoil portion 18 to facilitate the flow of a cooling fluid such as air therethrough. Various blade cooling arrangements are known in the art, and the cooling channels may be omitted entirely in some cases.

Due to the earlier-described harsh environment in and around an operating gas turbine engine, engine components are sometimes constructed using superalloy materials that have high strength, ductility, and creep resistance at high temperatures and relatively high resistance to corrosion. Superalloy materials may be based on nickel (Ni), cobalt (Co), or Ni-Iron. Examples of superalloys include alloys available under the trade names Hastelloy, Inconel, and René, such as René N4, René N5 or others. While the corrosion-resistance of superalloys may generally be considered very good as metal alloys are concerned, the elevated temperatures and stresses, corrosive combustion gases, and other elements (e.g., atmospheric pollutants or particulates, fuel additives and impurities, salts, etc.) in the gas turbine operating environment can accelerate the corrosion of even the most corrosion-resistant superalloys.

Various types of coatings or surface treatments have been developed in attempt to improve the corrosion-resistance of superalloy components for use in gas turbines. One type of coating that has been used for this purpose is an aluminide coating. Aluminide coatings generally include aluminum interdiffused with an underlying base material that is to be protected. Certain aluminide coatings, some of them including additional metal and/or metalloid components, are known to exhibit excellent resistance to high temperature corrosion and oxidation in gas turbine applications. But aluminide coatings may have the side effect of embrittling the surface of an otherwise sufficiently ductile base material, such as a superalloy material. Such embrittlement can lead to cracks in the surface of the coated component in high stress areas and/or in high fatigue areas, thereby exposing the underlying base material to accelerated corrosion or initiating mechanical failure.

Chromide coatings have also been proposed to improve the corrosion-resistance of superalloy components. Chromide coatings generally include chromium interdiffused with an underlying base material that is to be protected. Chromide coatings may not negatively affect the ductility of the base material to the degree that aluminide coatings do, but chromide coatings may be limited in their ability to resist corrosion at the high end of the range of gas turbine operating temperatures. As gas turbine engines are developed to have higher efficiency or power output, operating temperatures may generally increase. Thus, the available coatings for gas turbine components may be insufficient to provide the desired protection from corrosion, particularly in portions of the components that are subjected to high stresses or fatigue.

Figure 2:
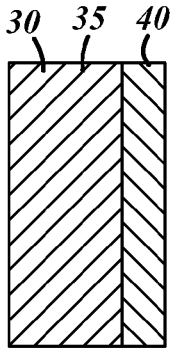
FIG. 2 is a cross-sectional view of a portion of a gas turbine component, including a protective coating according to one embodiment.

Referring to FIG. 2, a partial cross-section of a gas turbine component is shown, including a gas turbine component substrate 30, such as a blade substrate, and a protective coating 40. The substrate may be formed from a base material 35 by casting and/or other known processing techniques. The base material 35 may be a metal-based alloy capable of forming a gamma/gamma prime ($\gamma/\gamma'$) microstructure in which the gamma prime phase is in the form of a precipitate distributed within the gamma phase matrix. One example of such an alloy is a Ni-based superalloy that can form a gamma/gamma prime microstructure when heat-treated under certain conditions. For example, heat-treating a Ni-based superalloy can cause a gamma prime phase to form as a precipitate that includes $Ni_3Al$ and/or $Ni_3Ti$ distributed in a gamma phase that is a solid solution including Ni and other elements. Any of the above-mentioned exemplary superalloys, as well as other alloys capable of forming a gamma/gamma prime microstructure, may be suitable for use as the base material 35. The substrate 30 may also include materials or layers of materials other than base material 35. For example, substrate 30 may include a layer of base material 35 clad or otherwise attached to a different underlying material.

Protective coating 40 is a layer of material that includes an increased resistance to corrosion relative to base material 35. A coating may be classified as either an overlay coating or an interdiffused coating. Both types of coatings may be at least partially interdiffused with an underlying material, but any interdiffusion that is present with an overlay coating is in the form of a relatively thin layer at the interface of the overlay coating and the underlying material. An interdiffused coating has a substantial portion of its thickness interdiffused with the underlying material, and may be entirely interdiffused with the underlying material. For example, a chromide coating may include a layer of material that is more chromium-rich than the underlying material and further includes the constituent elements of the underlying material.

In one embodiment, the protective coating 40 is a non-aluminide interdiffused coating. That is to say that no aluminum or aluminum-containing material is coated over the substrate 30 to form the protective coating 40, or that the base material has not been aluminized. Thus the only aluminum that may be present in the protective coating 40 may be from the base material 35, for example in the form of a gamma prime phase such as $Ni_3Al$. Protective coating 40 may also include a platinum-group metal. One type of platinum-group metal is platinum (Pt). Pt-group metals include platinum, iridium, osmium, palladium, ruthenium, rhodium, and any combination thereof. In one embodiment, protective coating 40 includes Pt metal interdiffused with the base material 35 or other underlying material. In this instance, protective coating 40 may be described as a Pt-rich gamma/gamma prime coating. The Pt-rich gamma/gamma prime coating has increased resistance to corrosion compared to the base material 35 and may have higher corrosion-resistance than chromide coatings at some temperatures and/or to certain elements or compounds. When such a coating is produced by the methods described below, and possibly by other methods, the Pt-group metal is thought to reside primarily in the gamma prime phase of the base material 35 so that the protective coating 40 comprises a Ni-based solid solution gamma phase and a $Ni_3Al$ and/or $Ni_3Ti$ gamma prime precipitate phase that is rich in Pt-group metal. Additionally, a gamma/gamma prime coating rich in a Pt-group metal (also referred to herein as a Pt-group coating) such as platinum may have little to no effect on the ductility of the base material 35, thus offering the base material 35 superior protection from corrosion without substantially compromising its fatigue properties and/or other mechanical properties. The superior mechanical properties may also be accompanied by reduced weight compared to other coatings. For example, a non-aluminide Pt-group coating as described adds less weight to the coated component that a comparable Pt-aluminide coating and may thus be particularly advantageous in weight-sensitive applications such as smaller business class jet engines, helicopter turbines, and certain small engine military applications.

A gas turbine component including the gamma/gamma prime protective coating described above may be produced by the following illustrative method. A gas turbine component substrate that is constructed from the base material may be provided. A Pt-group metal is coated over the substrate by electroplating or other known techniques. The Pt-group metal is then interdiffused with the underlying material to form the Pt-group coating. The interdiffusion may be accomplished by heat treating the coated substrate. For example, the coated substrate may be placed in an inert or substantially evacuated environment at a temperature of about 1900° F. for 1 to 2 hours to interdiffuse the Pt-group metal with the underlying material at the substrate surface. Of course, these temperatures and times are non-limiting and may depend on several other factors. In one embodiment, Pt metal is electroplated over at least a portion of the substrate so that it has a thickness that ranges from about 0.1 to about 0.3 mils (2.5 to 7.5 μm). The plated substrate is then heat treated at the above-described conditions to interdiffuse the Pt and with the underlying material. The resulting protective coating may have a thickness that ranges from about 0.3 to about 2.0 mils (7.5 to 50 μm). The Pt-group metal may be coated and/or interdiffused with the base material using other methods. For example, the Pt-group metal may be coated onto the base material by ion-sputtering, CVD, PVD, slurry coating, molten dip-coating, or other suitable process. Interdiffusion may occur simultaneously in any deposition process that is performed at elevated temperatures in a range near the above-noted heat treating temperature.

Protective coating 40 may also include a chromide coating, though it is not required. A chromide coating is not shown separately in FIG. 2, because it is preferably an interdiffused coating, though it may be only partially interdiffused. Where present, the chromide coating may be coated over the base material using known techniques such as vapor phase deposition or another suitable process to impart the underlying material with a chromium-rich surface. Some chromide coating processes may occur at high temperatures so the chromium is deposited on and simultaneously interdiffused with the surface of the target material. Other processes such as a slurry coating process may deposit chromium onto the target material and undergo subsequent heat treating to interdiffuse the chromium with the underlying material. The chromide coating may be coated over the substrate 30 either before or after the Pt-group rich coating described above is coated over the substrate. Because both coatings are interdiffusion coatings, the resulting protective coating may be described as a gamma/gamma prime coating that is both chromium-rich and rich in Pt-group metal, regardless of the order in which the coatings are applied, though the gradient in chromium content may vary depending on the order in which the coatings are applied. Inclusion of the chromide coating in protective coating 40 may allow a thin oxide layer to form at the outer surface of the protective coating to further help prevent oxidation of the protective coating 40 and the base material 35 without embrittlement of the surface of the coated component. In embodiments where the Pt-group coating is applied over the base material after the chromide coating is applied, it may be preferable to adjust the chromide process to minimize the formation of alpha phase chrome at the surface of the coated material and/or to remove at least a portion of the chromide coating from the surface of the coated material prior to applying the Pt-group coating to facilitate interdiffusion of the Pt-group metal with the chromide coating.

Protective coating 40 may also include a dopant interdiffused therewith in a relatively small concentration, such as about 1.0 wt % or less, to promote coating adhesion and/or to form an oxide that further inhibits corrosion. One example of a suitable dopant is hafnium (Hf), though other transitional metals similar to Hf or Yttrium (Y) may also be used. Other examples include one or more rare earth metals. The dopant may be interdiffused with the protective coating in a separate process such as a vapor phase, CVD, or pack cementation process. Or the dopant may be simultaneously coated over the substrate with the chromate coating and/or the Pt-group coating and interdiffused therewith.

Referring again to FIGS. 1 and 2, the protective coating 40 may overlie one or more portions of the component substrate 30. In one embodiment, at least a portion of airfoil 12, shank 14, and/or platform 16 includes protective coating 40. In other words, one or more portions of any blade component may include protective coating 40. In one embodiment, at least a portion of the shank portion 20 includes protective coating 40. In another embodiment, both of the shank 14 and the underside 24 of platform 16 include protective coating 40. Protective coating 40 may overlie high stress regions of the blade substrate or regions that experience high levels of fatigue during use. Protective coating 40 may be particularly useful, for example, with shank portion 20 because it may experience higher levels of fatigue than the airfoil portion 18 and thus may not be able to successfully function with aluminide coatings or coatings that include aluminide such as Pt-aluminide coatings. Protective coating 40 may be coated over the entire component substrate 30, in some embodiments. For example, substantially the entire outer surface of turbine blade 10 in FIG. 1 may include protective coating 40. Where protective coating 40 includes both chromide and Pt-group coatings, each of the individual coatings may be selectively applied. For example, one or more portions of the turbine blade 10 may include a protective coating that includes chromide, and one or more other portions may omit the chromide coating. In one embodiment, protective coating 40 includes both the chromide coating and the Pt-group coating covering substantially all of the turbine blade substrate, and the chromide coating is applied over the turbine blade substrate before the Pt-group metal is coated over the substrate and interdiffused with the underlying Cr-rich surface.

Figure 3:
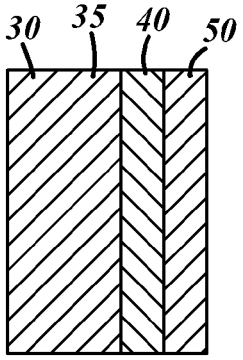
FIG. 3 is a cross-sectional view of a portion of a gas turbine component, including a protective coating and a supplemental coating, according to another embodiment.

As shown in FIG. 3, a supplemental coating 50 may be coated over protective coating 40 for additional functionality, such as additional corrosion-resistance, heat resistance, or another reason. Coating 50 may be an overlay coating or an interdiffused coating. It is shown in FIG. 3 as an overlay coating to separate it from protective layer 40 for descriptive purposes. One example of a supplemental coating 50 is an aluminide coating, as earlier described. Where present, the aluminide coating may be an interdiffused coating such that, when applied over protective coating 40, a Pt-aluminide coating may be formed. Aluminide or aluminide-based coatings may offer further corrosion-protection to the base material and other underlying materials, but is preferably not present over any portion of the shank portion of the turbine blade at least for some of the reasons articulated above. In other words, aluminide or aluminide-based coatings are preferably limited to the airfoil portion of a turbine blade. Aluminide coatings may not exhibit embrittlement problems over the airfoil portion because it is on the combustion gas side of the platform and operates at higher temperatures than the shank portion and may therefore be more ductile in the higher temperature range.

Supplemental coating 50 may optionally include a thermal barrier coating, such as a ceramic coating. In such an instance, supplemental coating 50 may itself be a multi-layer coating that includes a bond coating and an overlying ceramic coating. Any bond coating known in the art may be used. One such bond coating is a Pt-aluminide bond coating, which may be formed by aluminizing or applying an aluminide coating on the protective coating 40. Various ceramic coatings for use as thermal barriers with turbine blades and methods of applying them, such as electron-beam PVD and solution plasma spray (SPS), are known and may be suitable for use over protective layer 40.

Figure 4:
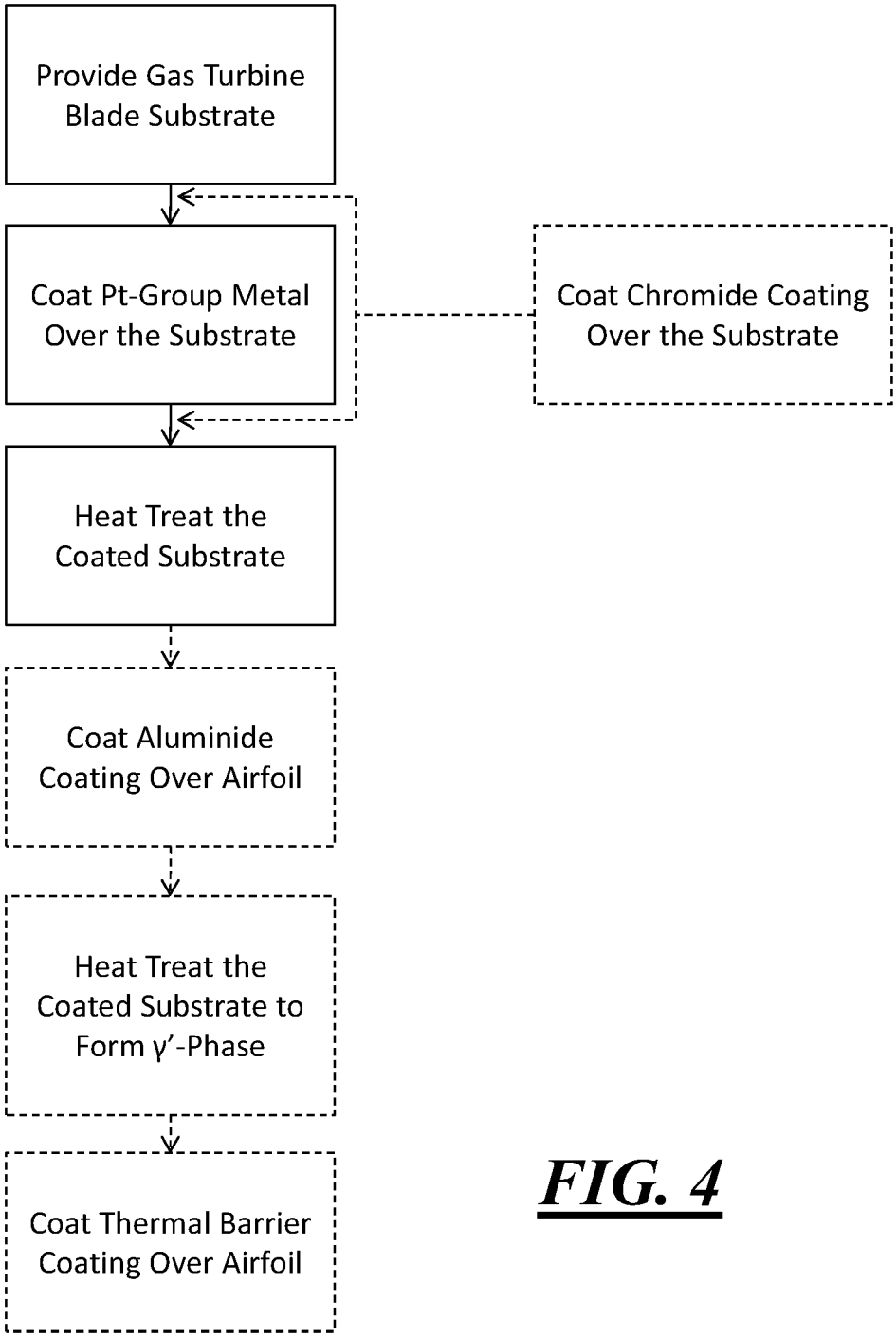
FIG. 4 is a process flow diagram illustrating a method of coating a gas turbine component substrate according to multiple embodiments.

According to one or more of the structures and methods described above, one specific embodiment of turbine blade 10 includes a turbine blade substrate coated with a platinum-rich gamma/gamma prime coating 40 over the shank portion 20, and further includes a Pt-aluminide coating over the airfoil portion 18. This particular embodiment of a turbine blade may be formed by an exemplary method that includes providing a turbine blade substrate that includes a Ni-based super alloy base material, electroplating platinum metal over the base material, heat treating the Pt-coated substrate to at least partially interdiffuse the Pt with the base material, coating an aluminide coating over the Pt coating at the airfoil portion of the substrate, and heat treating the coated substrate again for formation of the gamma prime phase in the base material and/or in the protective coating. In another embodiment, a chromide coating is coated over substantially the entire surface of the base material of the turbine blade substrate prior to the platinum plating. In yet another embodiment, a thermal barrier coating is coated over the airfoil portion of the blade after the gamma prime phase formation. FIG. 4 is a process flow diagram that illustrates one or more embodiments that may be useful to produce a gas turbine component according to the teachings presented herein. The process flow steps shown as dashed lines are optional steps.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

The invention claimed is:

1. A gas turbine component for use in a gas turbine engine, comprising:

a substrate comprising a Ni-based superalloy base material;

a non-aluminide protective coating disposed over at least a portion of the base material, the protective coating being an interdiffused coating comprising a platinum-group metal interdiffused with the Ni-based superalloy base material, wherein the protective coating further comprises a chromide coating comprising chromium interdiffused with the Ni-based superalloy base material and the platinum-group metal.

2. A gas turbine component as defined in claim 1 wherein the platinum-group metal is platinum.

3. A gas turbine component as defined in claim 1, wherein the protective coating further comprises a hafnium or rare-earth metal dopant.

4. A gas turbine component as defined in claim 1, wherein the component is a turbine blade comprising:

a platform having an underside and an opposite top side;

an airfoil portion that includes an airfoil and the topside of the platform; and a shank portion that includes a shank and the underside of the platform, wherein the protective coating is disposed over at least a portion of the shank portion.

5. A gas turbine component as defined in claim 4, wherein the protective coating is disposed over at least a portion of both of the shank portion and the airfoil portion.

6. A gas turbine component as defined in claim 4, further comprising an aluminide coating disposed over at least a portion of the airfoil portion.

7. A gas turbine blade, comprising:

a platform having an underside and an opposite topside;

an airfoil portion that includes an airfoil and the topside of the platform;

a shank portion that includes a shank and the underside of the platform; and a platinum-group metal interdiffused with a superalloy base material of at least a portion of both of the airfoil portion and the shank portion, wherein at least a portion of the airfoil portion is aluminized and the shank portion is non-aluminized.

8. A gas turbine as defined in claim 7, wherein both of the airfoil portion and the shank portion comprise a Ni-based superalloy base material and the platinum-group metal is interdiffused with the base material.

9. A gas turbine as defined in claim 7, further comprising a chromide coating disposed over the at least a portion of both of the airfoil portion and the shank portion.

10. A method of coating a gas turbine blade for use in a gas turbine engine, the method comprising the steps of:

interdiffusing a platinum-group metal with a base material of at least a portion of a shank portion of a turbine blade substrate; and coating an aluminide coating over the base material of at least a portion of the turbine blade substrate, wherein said at least a portion of the substrate in the step of coating the aluminide coating does not include any portion of the shank portion.

11. The method of claim 10, further comprising the steps of:

coating a layer of the platinum-group metal over the at least a portion of the shank portion to form a coated substrate; and heat treating the coated substrate to interdiffuse the platinum-group metal with the base material.

12. The method of claim 11, wherein the step of coating the layer of platinum-group metal includes electroplating.

13. The method of claim 10, further comprising the step of coating a chromide coating over the at least a portion of the shank portion.

14. The method of claim 13, wherein the step of coating the chromide coating is performed before the step of interdiffusing the platinum-group metal.

15. The method of claim 13, wherein the step of coating the chromide coating is performed after the step of interdiffusing the platinum-group metal.

16. The method of claim 10, further comprising interdiffusing the platinum-group metal with the base material of at least a portion of an airfoil portion of the turbine blade substrate.

17. The method of claim 11, wherein the step of coating the layer of platinum-group metal includes slurry coating.

18. The method of claim 10, further comprising interdiffusing the platinum-group metal with the base material of at least a portion of an airfoil portion of the turbine blade substrate before the step of coating the aluminide coating.

19. The method of claim 10, further comprising the step of coating a thermal barrier coating over at least a portion of the turbine blade substrate.

20. A non-aluminide corrosion-resistant coating comprising a platinum-group metal and a gamma/gamma prime microstructure, wherein the platinum-group metal of the coating resides in the gamma prime phase of the microstructure.

* * * * *